US005582143A

United States Patent [19]

Stark et al.

[11] Patent Number: 5,582,143

[45] Date of Patent: Dec. 10, 1996

[54] ACTUATING DEVICE FOR A DECOMPRESSION VALVE OF AN INTERNAL COMBUSTION ENGINE WITH CABLE STARTER

[75] Inventors: Thomas Stark, Waiblingen; Rudolf Krebs, Backnang; Helmut Zimmermann, Kernen; Harald Schliemann, Waiblingen; Jörg Schlossarczyk, Winnenden, all of Germany

[73] Assignee: Andreas Stihl, Waiblingen, Germany

[21] Appl. No.: 389,170

[22] Filed: Feb. 15, 1995

[30] Foreign Application Priority Data

Feb. 19, 1994 [DE] Germany ..... 44 05 313.4

[51] Int. Cl.[6] ..... F02N 17/08

[52] U.S. Cl. ..... 123/182.1

[58] Field of Search ..... 123/182.1

[56] References Cited

U.S. PATENT DOCUMENTS

| | | | |
|---|---|---|---|
| 3,687,124 | 8/1972 | Kolorz | 123/182.1 |
| 5,361,738 | 11/1994 | Iida | 123/182.1 |
| 5,379,734 | 1/1995 | Tsunodâ et al. | 123/182.1 |

FOREIGN PATENT DOCUMENTS

| | | | |
|---|---|---|---|
| 4041250 | 7/1991 | Germany . | |
| 57-86559 | 5/1982 | Japan | 123/182.1 |

*Primary Examiner*—Andrew M. Dolinar
*Attorney, Agent, or Firm*—Robert W. Becker & Associates

[57] ABSTRACT

An actuating device for a decompression valve of an internal combustion engine with a cable starter, wherein the decompression valve is positioned within the cylinder of the internal combustion engine and comprises a valve member biased into its closed position, has a transmission lever having a longitudinal extension and being rotatable about its longitudinal axis. The transmission lever has a first and a second end. A cable drum for receiving the starter cable of the cable starter is provided. The cable drum has an axis of rotation about which the cable drum is rotated when the starter cable is pulled. The longitudinal axis of the transmission lever is perpendicular to the axis of rotation of the cable drum and spaced from the rotational plane of the cable drum. The cable drum entrains the first end of the transmission lever in the direction of rotation and thereby rotates the transmission lever about its longitudinal axis such that the second end of the transmission lever performs an adjusting movement for moving the decompression valve from the closed position into the open position.

24 Claims, 4 Drawing Sheets

Fig. 2
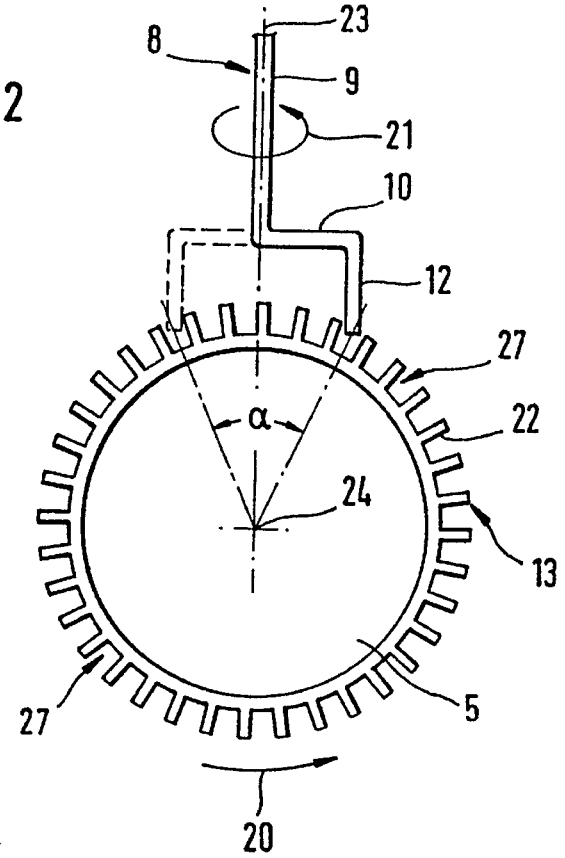
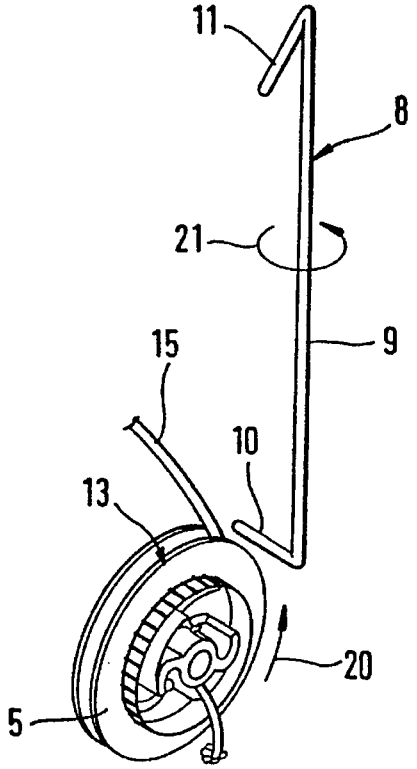
Fig. 3

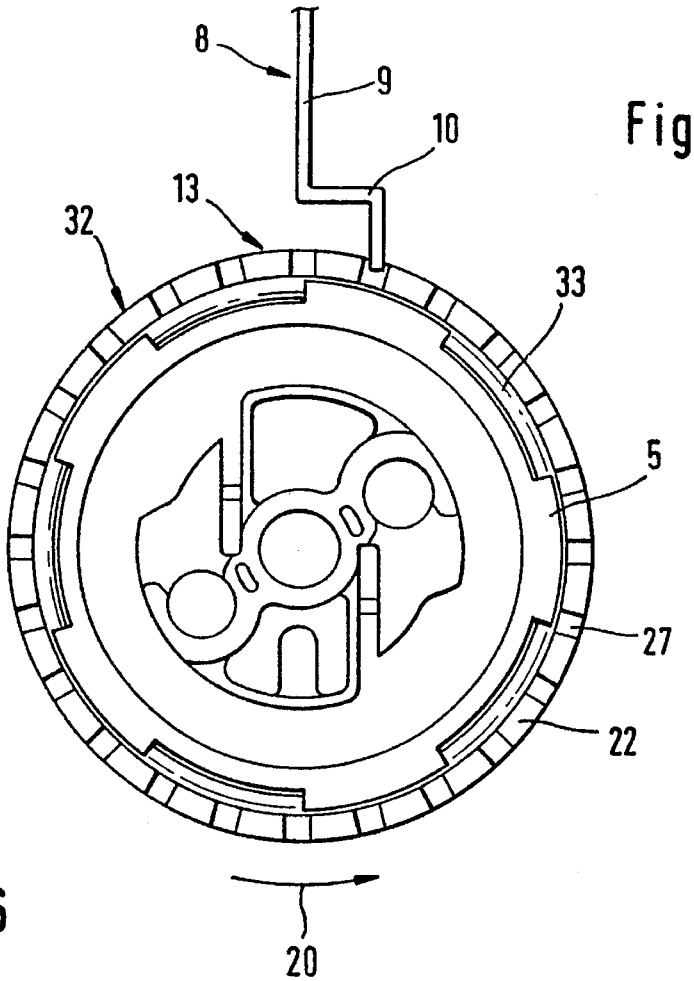
Fig. 5
Fig. 6
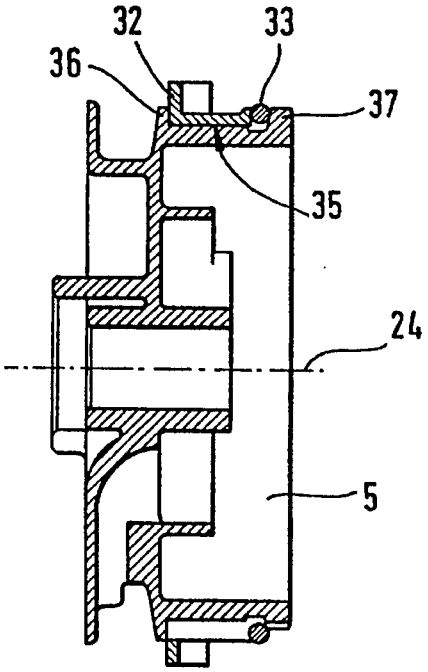
Fig. 7
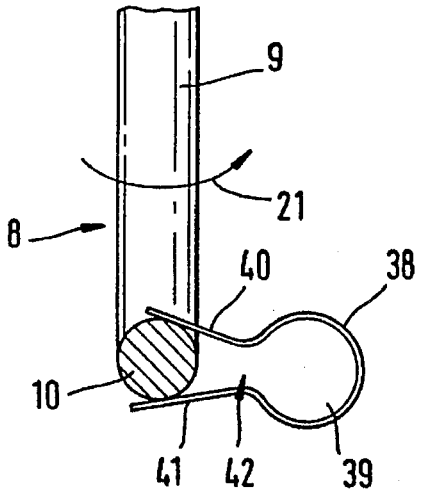

ACTUATING DEVICE FOR A DECOMPRESSION VALVE OF AN INTERNAL COMBUSTION ENGINE WITH CABLE STARTER

BACKGROUND OF THE INVENTION

The present invention relates to an actuating device for a decompression valve of an internal combustion engine with cable starter, especially of an internal combustion engine of a hand-held working tool such as a motor chain saw, a cutter etc., wherein within the cylinder of the combustion engine a decompression valve is arranged the valve member of which is biased into its closed position. A transmission lever that is rotatable about its longitudinal axis is positioned with its longitudinal axis at a distance to the rotational plane of the cable drum of the starter cable and is positioned perpendicular to the rotational axis of the cable drum. A movement resulting from the rotation of the cable drum results in a first end of the transmission lever being rotated about its longitudinal axis so that a second end of the transmission lever performs an adjusting movement in the opening direction of the valve member.

From U.S. Pat. No. 3,687,124, an actuating device of the aforementioned kind is known with which the starting operation of an internal combustion engine to be started manually is to be facilitated by pressure release of the combustion chamber during the compression stroke. In the upper area of the combustion chamber a decompression valve is arranged that is comprised substantially of an axially movable valve member which closes an outlet channel. The valve member is forced into the closed position by a spring. For pressure release the valve member must be opened against the force of the spring. For this purpose, a transmission lever engages the valve member which transmits an axial coupling movement generated upon actuation of the cable starter of a coupling member onto the valve member and thus transfers the valve member into the open position. When the internal combustion engine is started, the coupling member, which is part of an overriding clutch, is axially returned so that the transmission lever is also returned and the valve member of the decompression valve closes. The combustion chamber of the cylinder is thus again tightly closed.

The control (adjusting) movement for opening and closing the decompression valve is derived from an axial movement of the coupling member. In a cable starter of a smaller constructive size, as used for hand-held working tools, an axially movable coupling part is not present so that the decompression valve cannot be actuated with the known device.

It is therefore an object of the present invention to provide an actuating device of the aforementioned kind for a decompression valve of a combustion engine with a cable starter such that even with a constructively small cable starter without axially displaceable component a simple and reliable automatic actuation of the decompression valve is possible.

SUMMARY OF THE INVENTION

The actuating device for a decompression valve of an internal combustion engine with a cable starter, wherein the decompression valve is positioned within the cylinder of the internal combustion engine and comprises a valve member biased into its closed position, according to the present invention is primarily characterized by:

A transmission lever having a longitudinal extension and being rotatable about its longitudinal axis, the transmission lever having a first and a second end;

A cable drum for receiving the starter cable of the cable starter, the cable drum having an axis of rotation about which the cable drum is rotated in a direction of rotation when the starter cable is pulled;

The longitudinal axis of the transmission lever positioned perpendicular to the axis of rotation of the cable drum and spaced from a rotational plane of the cable drum; and Wherein the cable drum entrains the first end of the transmission lever in the direction of rotation and thereby rotates the transmission lever about the longitudinal axis such that the second end of the transmission lever performs an adjusting movement for moving the decompression valve from the closed position into an open position.

Preferably, the cable drum has an outer mantle surface and the first end of the transmission lever rests frictionally on the outer mantle surface of the cable drum.

Advantageously, the outer mantle surface is in the form of a friction ring frictionally connected to the cable drum. Expediently, the actuating device further comprises a spring ring positioned between the friction ring and the cable drum for frictionally connecting the friction ring to the cable drum.

In a preferred embodiment of the present invention, the cable drum has an outer mantle surface with teeth connected thereto in a spaced arrangement and the first end of the transmission lever engages form-fittingly between adjacent ones of the teeth. Advantageously, the teeth are spaced equidistantly.

Preferably, the outer mantle surface is in the form of a friction ring frictionally connected to the cable drum. Preferably the device further comprises a spring ring positioned between the friction ring and the cable drum for frictionally connecting the friction ring to the cable drum.

Expediently, the cable drum has an outer mantle surface and the first end of the transmission lever rests under prestress on the outer mantle surface.

Preferably, the longitudinal axis of the transmission lever intercepts the axis of rotation of the cable drum.

In yet another embodiment of the present invention the transmission lever is comprised of a transmission rod coinciding with the longitudinal axis of the transmission lever, whereby the transmission rod has angled end pieces forming the first and second ends of the transmission lever.

Preferably, the first end of the transmission lever comprises a projection extending substantially parallel to the longitudinal axis of the transmission lever and engaging the cable drum substantially in a radial direction of the cable drum.

Advantageously, the actuating device further comprises an abutment for limiting the adjusting movement of the second end for opening the decompression valve.

Preferably, the rotational travel of the transmission lever for moving the decompression valve from the closed position into an open position is completed when the cable drum is rotated about a rotational angle of 20° to 60° Preferably, the rotational angle is 45°.

Expediently, the actuating device further comprises a guide for the transmission lever, the guide being connected to the cylinder.

Advantageously, the transmission lever is supported at a cover for the engine.

Preferably, the transmission lever is made of a material with a high elasticity module. Preferably, this material is spring steel.

According to the present invention, the actuation of the decompression valve is possible exclusively with a pivoting or rotational movement of the transmission lever initiated by a rotational movement of the cable drum whereby a small rotational angle of the cable drum at the beginning of the starting operation is already sufficient in order to generate the pivoting movement of the transmission lever needed for opening the decompression valve. In a corresponding manner a small rotational angle of the cable drum in the counter direction is sufficient to effect an immediate closure of the decompression valve at the end of the starting operation.

Advantageously, the first end of the transmission lever rests frictionally on the outer mantle surface of the cable drum, for example radially thereto. Upon a rotational movement of the cable drum, the first end of the transmission lever is entrained in the rotational direction of the cable drum until it reaches its end position due to the pivoting movement of the transmission rod.

In a preferred embodiment the longitudinal axis of the transmission lever and the rotational axis of the cable drum intercept one another. Since the rotational axis of the cable drum coincides with the crankshaft axis, the transmission lever is arranged centrally with respect to the crankshaft.

Expediently, the first end of the transmission lever in the rotational direction is positioned between teeth that are provided at the outer mantle surface of the cable drum in its circumferential direction. The teeth are preferably spaced equidistantly from one another. This form fitting connection ensures that a secure connection between the cable drum and the transmission lever is achieved whereby the rotational end positions of the first end of the transmission lever are also predetermined.

The first end of the transmission lever can also rest on the outer mantle surface of a friction ring which is supported with frictional connection on the cable drum. The frictional connection between the cable drum and the friction ring is advantageously produced with a spring ring. When the frictional force between the cable drum and the friction ring is surpassed, the friction ring rotates about the cable drum.

Preferably, the first end of the transmission lever rests under prestress on the mantle surface of the cable drum.

BRIEF DESCRIPTION OF THE DRAWINGS

The object and advantages of the present invention will appear more clearly from the following specification in conjunction with the accompanying drawings, in which:

FIG. 2 shows a schematic view of the cable drum with engaged transmission levers;

FIG. 3 shows a perspective view of the cable drum and the transmission lever engaged thereat in a further embodiment;

FIG. 5 shows a frontal view of the cable drum with external friction ring;

FIG. 6 shows a side view of the cable drum of FIG. 5; and

FIG. 7 shows a schematic view of a clamping spring and a snap-on transmission lever.

DESCRIPTION OF PREFERRED EMBODIMENTS

The present invention will now be explained in detail with the aid of several specific embodiments utilizing the FIGS. 1 through 7.

Figure 1:
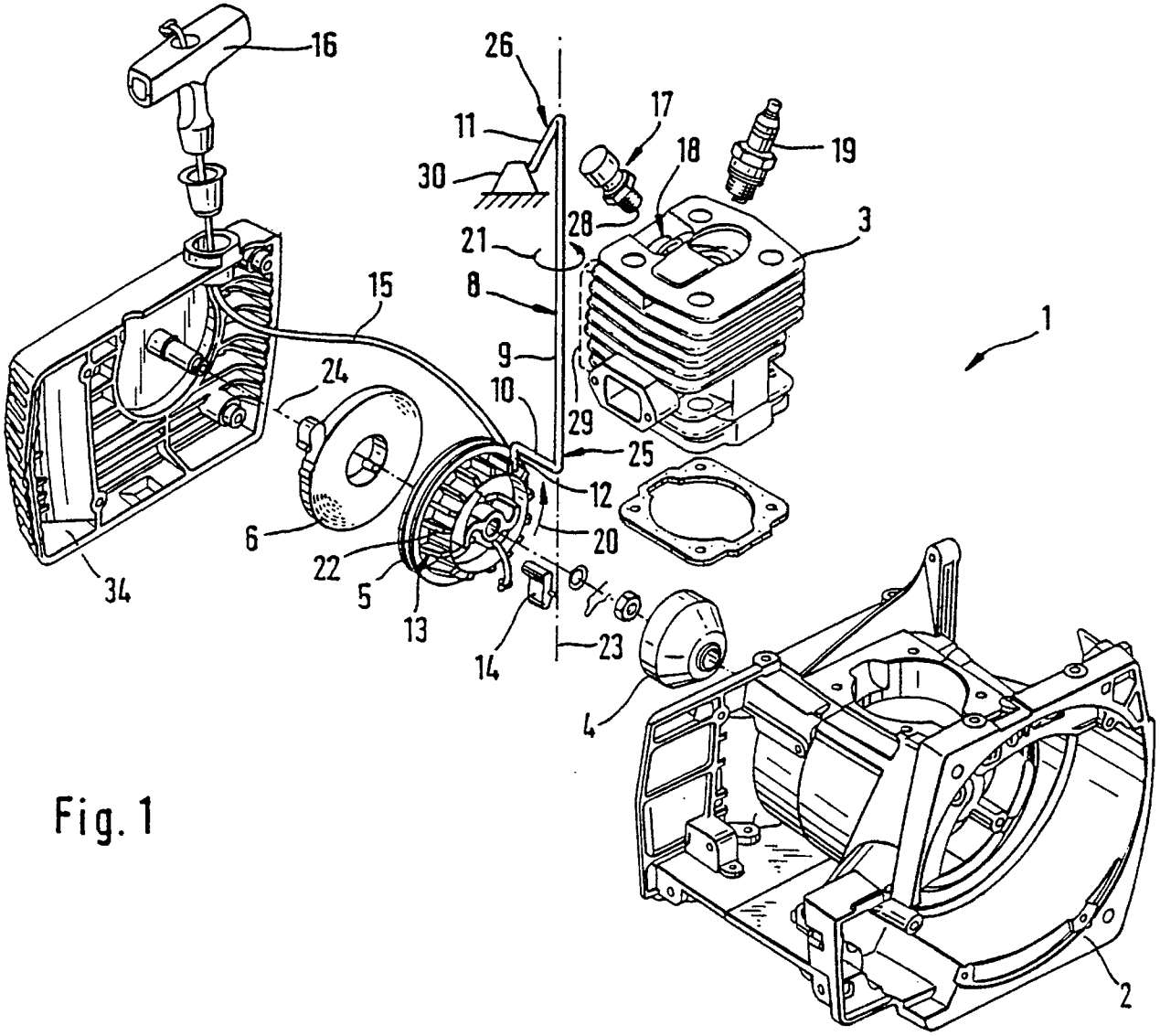
FIG. 1 shows a schematic exploded view of an internal combustion engine with cable starter, a decompression valve, a transmission lever, and a cable drum.

In FIG. 1 an internal combustion engine, especially a two-stroke engine, of a hand-held working tool with cable starter is shown as, for example, used in motor chain saws, cutters, trimmers, etc. The cable starter is arranged within a starter cover 34 and comprises a cable drum 5 with a cable 15 wound thereon and a grip 16 connected to the free end of the cable 15. When an operator pulls the cable 15, the cable drum 5 is rotated and a radially pivotable pawl 14 is pivoted into engagement with a coupling cup 4 which is fixedly connected to the crankshaft of the internal combustion engine. Due to the rotating crankshaft the piston positioned within the cylinder 3 is moved up and down so that the airfuel mixture present within the combustion chamber of the cylinder 3 is compressed and ignited by the spark plug 19.

In order to reduce the amount of force needed by the operator for starting the engine, a decompression valve 17 is provided within the cylinder 3. This compression valve 17 comprises a valve member 28 that upon actuation of the cable starter opens and thereby frees a connecting channel between the combustion chamber and the atmosphere, respectively, the crankcase so that the pressure within the combustion chamber is reduced. During the starting operation it is thus also possible to achieve higher starter rpms which favors a quick and reliable starting of the engine for a minimal number of starting trials.

The valve member 28 is actuated by a transmission lever 8 that transmits the rotational movement of the cable drum 5 as an opening movement onto the valve member 28 and moves the valve member 28 into the open position. The transmission lever 8 extends transverse to the rotational axis 24 of the cable drum 5 and pivots exclusively with a rotating movement about its rotational axis 23 which in the shown embodiment coincides with the longitudinal axis of the transmission lever and which extends preferably approximately perpendicular to the rotational axis 24 of the cable drum 5. It may be advantageous in this context that the longitudinal axis 23 of the transmission lever 8 has a point of interception with the rotational axis 24 of the cable drum 5, i.e., that the transmission lever 8 is arranged at the center of the crankshaft. In order to be able to derive a control movement (adjusting movement) from the movement of the cable drum 5 and to transfer this movement onto the decompression valve, the longitudinal axis 23 of the transmission lever 8 is positioned at a distance to the rotational plane of the cable drum 5. One end 10 of the transmission lever 8 is entrained during the starting operation by the cable drum 5 in the rotational direction 20 so that the other end 11 carries out the adjustment movement (pivoting movement) about the rotational axis.

The transmission lever 8 is comprised advantageously of a transmission rod 9 that is provided at its axial end sections with suitable means 25, 26 that are in engagement with the cable drum 5, respectively, the decompression valve 17 and provide for transmission of the rotational movement of the cable drum 5 onto the decompression valve 17. According to FIG. 1, angled end pieces 10 and 11 are provided at the axial end sections of the transmission rod 9. The end piece 10 cooperating with the cable drum 5 can be comprised of a relatively short lever relative to the length of the transmission rod 9. The end piece 10 engages the outer mantle surface 13 of the cable drum 5. When the rod 9 is in a center position, the angled end piece 10 extends substantially parallel to the rotational axis 24 of the cable drum 5. The transmission rod 9 and the end piece 10 are positioned at a right angle relative to one another. In the embodiment according to FIGS. 1 and 2, the angular end piece 10 is provided with a projection 12 at its end face facing away from the transmission rod 9. This projection 12 extends approximately parallel to the longitudinal axis 23 of the transmission rod 9 and rests radially on the outer mantle surface 13 of the cable drum 5. For transmitting the rotational movement of the cable drum 5 onto the transmission lever 8, the projection 12, which extends approximately at a right angle from the angular end piece 10, engages according to FIG. 2 form-fittingly the intermediate spaces 27 of tooth-like projections (teeth) 22 which extend in the axial direction 24 of the cable drum 5 and project radially outwardly. The projection 12 advantageously has, as does the transmission rod 9, a circular cross-section so that the rotational movement upon pivoting of the transmission lever is not impaired by the lateral flanks of the teeth 22. The projection 12 is advantageously arranged above the outer mantle surface 13 of the cable drum 5 such that in the central position of the transmission lever 8, when the projection 12 is exactly radially positioned to the rotational axis 24 of the cable drum 5, the end of the projection 12 facing away from the angled end piece 10 does not contact the bottom of the intermediate spaces 27. The projection 12 preferably is at least as tall as the height of the teeth 22 so that the angular end piece 10 is not impaired by the teeth 22 during the pivoting movement.

The lever-like angular end piece 10 expediently can also engage axially between the intermediate spaces 27 of the teeth 22 of the cable drum 5. It may be advantageous in this context to arrange the transmission lever 8 such that the angular end piece 10 rests under prestress on the bottom of the intermediate spaces 27 so that a radial pressure is exerted onto the cable drum 5. Under these conditions a frictional connection between the first angular end of the transmission lever 8 and the cable drum 5 is achieved so that the outer mantle surface 13 of the cable drum 5 can be of a planar embodiment (i.e., no projection or teeth) as shown in FIG. 3. By providing a rough surface or a friction coating on the outer mantle surface 13 the frictional connection can be improved.

In another not represented embodiment the end 10 of the transmission rod 9 can also be in the form of a toothed wheel that engages the teeth 22 and causes a pivoting movement of the transmission lever 8 as described above. However, the toothed wheel is to be connected with a slip coupling to the transmission lever 8 in order to ensure in the end positions of the transmission lever a further rotation of the cable drum.

The angular end piece 10 may also rest under prestress axially at the end face of the cable drum 5 which end face for this purpose is expediently also provided with a rough surface or a friction coating in order to increase friction.

During starting of the engine by pulling on the cable 15, the cable drum 5 rotates in the direction of arrow 20 and entrains the angular end piece 10 of the transmission lever 8 in the direction of arrow 21. The second angular end piece 11 rests at the valve member 28 of the decompression valve 17 and the valve member 28 is moved from its closed position into the open position counter to the force of the return spring 6 so that the compression within the combustion chamber of the cylinder is reduced. The valve member 28 is opened already with a small rotational movement of the cable drum 5 and the thus resulting pivoting movement of the transmission lever 8 in direction of arrow 21. Upon further rotation of the cable drum 5, the teeth 22 pass along the angular end 10 of the transmission lever 8 in the manner of a ratchet. The valve member 28 of the decompression valve 17 in the open position forms an abutment for the pivoting movement of the transmission lever 8. The first end 10 performs the required adjusting movement for moving the decompression valve 17 from the closed into the open position upon a rotation angle of the cable drum 5 of approximately 20° to 60°. In the embodiment according to FIG. 2 this rotational angle $\alpha$ is approximately 45°.

The cable drum 5 is connected with the pawl 14 to the coupling cup 4, when the cable 15 is in the pulled position. In order to allow for a starting of the engine by ignition of the air-fuel mixture within the combustion chamber with the aid of the spark plug 19, the decompression valve 17 should be in the closed position. For this purpose, a small return movement of the cable drum 5 is sufficient which can be initiated by a spiral-shaped return spring 6. The closure of the decompression valve 17 can also be initiated by the combustion pressure within the combustion chamber which, after ignition of the airfuel mixture, can force the decompression valve 17 into its closed position. The second angular end piece 11 of the transmission lever 8 which abuts the valve member 28 follows this closing movement so that the first end piece 10 is also returned and a return movement of the cable drum 5, supported by the force of the return spring 6, is initiated.

For controlling the decompression valve 17 the lever geometry of the transmission lever 8 can be varied, for example, by embodying the angular end pieces 10 and 11 of different length. This has the advantage that a more favorable transmission ratio can be achieved with the lever and that only a small force for opening the decompression valve 17 is required. The same effect can also be achieved with different angles between the end pieces 10 and 11 relative to the transmission rod. The adjusting stroke of the end piece 11 which faces the decompression valve 17 is preferably limited by an abutment 30 in the closed position of the decompression valve 17. This abutment 30 is elastically embodied and, for example, connected to the cover 7 of the engine. This also limits the adjustment stroke of the lower end 10 so that in the closed position of the decompression valve it is ensured reliably that the lower end 10 is always in engagement with the outer mantle surface 13 of the cable drum 5. In the same manner the open position of the decompression valve 17 can be limited by an abutment which maintains the lower end 10 in contact with the outer mantle surface. In order to prevent a blocking of the cable drum 5, respectively, in order to guarantee that the lever 8 can always follow a change in the rotational direction, it is suggested to employ an elastically yielding transmission lever 8 made of a material with a high elasticity module, for example, spring steel so that a torsional movement of the transmission rod, respectively, a yielding of the angled end pieces 10 and 11 is possible.

It has been proven to be expedient to select the width of the end piece 10 that engages the intermediate space 27, respectively, the width of the projection 12 such that it is slightly less than the distance between two adjacent teeth 22.

In another embodiment according to FIG. 5 and 6 the transmission lever 8 rests on the outer surface 13 of a friction ring 32 which is supported in frictional connection on the cable drum 5. The frictional connection is expediently achieved with a spring ring 33 that is positioned between the friction ring 32 and the cable drum 5. The friction ring 32 and the spring ring 33 are advantageously arranged such in a receiving groove 35 at the periphery of the cable drum 5 that the spring ring 33 forces the friction ring 32 axially against a limiting wall 36 of the receiving groove 35 whereby the spring ring 33 in the opposite direction is supported at the oppositely arranged limiting wall 37. The frictional force exerted by the spring ring 33 onto the friction ring 32 has the effect that the friction ring 32 can rotate about the cable drum 5 only upon surpassing this frictional force. The frictional force is selected such that it is greater than the force that is necessary for opening the decompression valve 17. The transmission lever 8 engages with its angular end piece 10 the intermediate spaces 27 which are arranged on the outer surface 13 of the frictional ring 32 between the teeth 22. Upon actuating the cable starter, the cable drum 5 is rotated in the direction of arrow 22 and due to the frictional force between the friction ring 32 and the spring ring 33 entrains the friction ring 32 in the rotational direction so that the decompression valve 17 is opened due to the rotation of the transmission lever 8. Due to the resulting decompression of the combustion chamber a relatively small pulling force at the cable 15 of the cable starter is sufficient to bring the cable drum 5 to a sufficiently high rotational velocity for starting the engine. When the cable 15 is completely pulled out and the engine has ignited, a relatively short return movement of the cable drum 5 is sufficient in order to close the decompression valve. In the combustion chamber the full compression pressure is now present and the engine can be accelerated as desired. During this step no relative movement between the friction ring 32 and the cable drum 5 takes place so that opening and closing of the decompression valve 17 function in the same manner as described in the aforementioned embodiments of FIGS. 1 to 4.

In the case that the engine is ignited at an earlier point in time, i.e., the cable 15 has not been completely pulled, the decompression valve 17 is closed by the rapidly increasing pressure within the combustion chamber. The closing movement of the decompression valve 17 is transmitted via the transmission lever 8 onto the friction ring 32. The closing force, which is exerted by the combustion chamber inner pressure onto the decompression valve, surpasses the frictional force between the friction ring 32 and the spring ring 33 so that the friction ring 32 performs a return movement even when the cable drum 5 is still rotated forwardly by the force exerted by the operator. The friction ring 32 rotates relative to the cable drum 5 so that at the moment of first ignition the decompression valve 17 is in the closed position without being blocked by the further rotating movement of the cable drum 5.

It may be expedient to provide catch positions for the open and closed position of the decompression valve. For this purpose, a clamping spring 38 is provided (see FIG. 7) into which preferably the lower end 10 of the transmission lever 8 is pivoted in order to fix the open position of the decompression valve 17. The clamping spring 38, which is preferably mounted on the engine cover 7, encloses a substantially circular inner space 39 for receiving the lower end 10 of the transmission lever 8 and is open at the side facing the lower end 10. This opening is delimited by sidewalls 40 and 41 which in the direction of the interior (inner space) 39 of the clamping spring 38 converge and delimit a passage 42 the height of which is smaller than the diameter of the lower end 10 of the transmission lever 8. This ensures that the force which is required to pivot the lower end 10 into the interior 39 (open position of the decompression valve) is smaller than the force that is required for removing the lower end 10 from the catch position in the interior 39.

The use of the clamping spring 38 for fixing the decompression valve 17 in the open position is especially suitable in connection with the aforementioned frictionally connected friction ring 32 supported on the cable drum 5. The clamping spring 38 is expediently dimensioned such that the force that is required for pivoting the lower end 10 of the transmission lever 8 into the catch position is smaller than the frictional force between the friction ring 32 and the spring ring 33 whereby in contrast thereto the force for releasing the lower end 10 from the catch position is greater than the frictional force between the friction ring 32 and the spring ring 33. Upon actuating the starting device, the lower end 10 of the transmission lever 8 is pivoted into the interior 39 of the clamping spring 38 whereby due to the frictional force between the friction ring 32 and the spring ring 33 the friction ring 32 together with the cable drum 5 is rotated. Due to the fixation of the lower end 10 in the clamping spring 38 a return force of the valve member 28 is not transmitted from the decompression valve 17 via the transmission lever 8 onto the cable drum 5. This favors an actuation of the starting device with a minimal pulling force. After ignition of the engine the force that is present within the interior of the combustion chamber forces the lower end 10 of the transmission lever 8 out of its catch position in the clamping spring 38 so that the transmission lever 8 can return into its initial position and the valve member 28 of the decompression valve 17 is returned in its closed position.

However, if after the first starting operation the engine has not ignited, the lower end 10 of the transmission lever 8 remains in the catch position within the clamping spring 38 so that the decompression valve 17 remains in the open position. The force of the return spring 6 of the cable drum 5 effects a return of the cable drum 5 into its initial position, while the friction ring 32 due to the engagement of the lower end 10, respectively, of the projection 12 remains in its present position. The cable drum 5 rotates accordingly under the friction ring 32 and is returned into its initial position from which a new starting operation can be initiated. With this arrangement the decompression valve 17 must be moved into the open position only once even for a plurality of starting trials. It may be advantageous in this context that in the catch position the transmission lever 8 is no longer in engagement with the cable drum 5, respectively, with the friction ring 32 so that the wear of the transmission lever 8 and of the decompression valve 17 is minimized. After ignition of the fuelair mixture the transmission lever 8, is returned into engagement with the friction ring 32 due to the inner pressure within the combustion chamber and pivots back into the closed position independent of the position of the cable drum 5.

In a non-represented embodiment the function of the clamping spring 38 can be performed directly by the decompression valve 17 having an integrated catch, for example, via a catch spring or a spring-loaded ball that engage a correspondingly formed mantle surface at the valve body 28 whereby the function of these elements corresponds to the one described in connection with the clamping spring 38.

Figure 4:
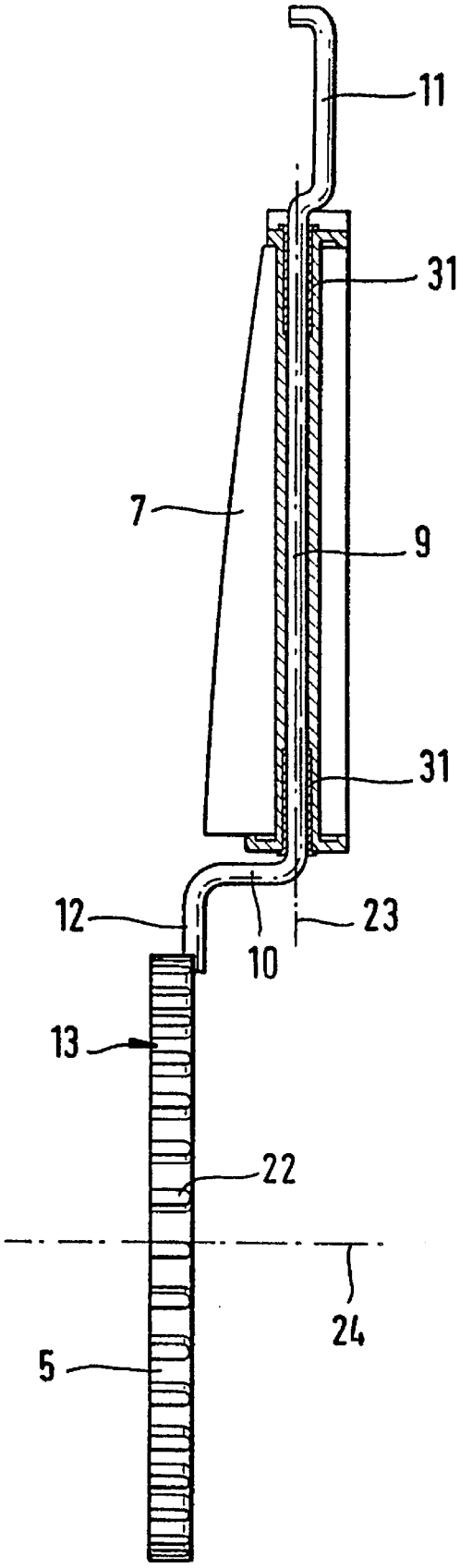
FIG. 4 shows a side view of a cable drum and a transmission lever that is supported on a cover of the internal combustion engine.

The transmission lever 8 of FIG. 1 is supported in a guide 29 at the cylinder 3 or, in another embodiment according to FIG. 4, at the cover 7 of the engine. In order to avoid bending of the transmission lever, respectively, transmission rod 9, the guidesupport can extend over the entire length of the transmission rod 9. However, it is also possible to support the transmission lever 8 at the engine block 2. The transmission lever 8 is advantageously secured in the guide or guiders with bearing sleeves 31 that are fixedly connected to the transmission rod 9 (FIG. 4).

The transmission rod 9 advantageously forms together with the angular end pieces 10 and 11 advantageously a one-part component that can be produced with little expenditure.

The actuating device for the decompression valve can also be used in connection with an electric starter. Especially for hand-held working tools it must be taken into consideration that the total weight of the working tool must be as small as possible in order to allow for a fatigue-free working over an extended period of time. For this reason, an electric motor which is to be used as the starter for the combustion engine must be as small as possible. This suggests the use of a decompression valve in order to allow a starting of the combustion engine with low starting forces. For such an electric starter the adjusting movement (control movement) for adjusting (moving) the transmission lever from the closed to the open position of the decompression valve is derived from a rotating component of the electric starter. After starting of the internal combustion engine, the transmission lever is returned and the valve member of the decompression valve is closed again.

The present invention is, of course, in no way restricted to the specific disclosure of the specification and drawings, but also encompasses any modifications within the scope of the appended claims.

What we claim is:

1. An actuating device for a decompression valve of an internal combustion engine with a cable starter, wherein the decompression valve is positioned within a cylinder of the internal combustion engine and comprises a valve member biased into its closed position; said actuating device comprising:

a transmission lever having a longitudinal extension and being rotatable about its longitudinal axis, said transmission lever having a first and a second end;

a cable drum for receiving the starter cable of the cable starter, said cable drum having an axis of rotation about which said cable drum is rotated in a direction of rotation when the starter cable is pulled;

said longitudinal axis of said transmission lever positioned perpendicular to said axis of rotation of said cable drum and spaced from a rotational plane of said cable drum;

wherein said cable drum has an outer mantle surface and wherein said first end of said transmission lever rests frictionally on said outer mantle surface of said cable drum; and wherein said cable drum frictionally entrains said first end of said transmission lever in said direction of rotation and thereby rotates said transmission lever about said longitudinal axis such that said second end of said transmission lever performs an adjusting movement for moving said decompression valve from the closed position into an open position.

2. An actuating device according to claim 1, wherein said first end of said transmission lever rests under prestress on said outer mantle surface.

3. An actuating device according to claim 1, wherein said longitudinal axis of said transmission lever intercepts said axis of rotation of said cable drum.

4. An actuating device according to claim 1, wherein said transmission lever is comprised of a transmission rod coinciding with said longitudinal axis of said transmission lever, said transmission rod having angled end pieces forming said first and second ends of said transmission lever.

5. An actuating device according to claim 1, further comprising an abutment for limiting said adjusting movement of said second end for opening said decompression valve.

6. An actuating device according to claim 1, wherein a rotational travel of said transmission lever for moving said decompression valve from the closed position into an open position is completed when said cable drum is rotated about a rotational angle of 20° to 60°.

7. An actuating device according to claim 6, wherein said rotational angle is 45°.

8. An actuating device according to claim 1, further comprising a guide for said transmission lever, said guide connected to the cylinder.

9. An actuating device according to claim 1, wherein said transmission lever is supported at a cover for the engine.

10. An actuating device according to claim 1, wherein said transmission lever is made of a material with a high elasticity module.

11. An actuating device according to claim 10, wherein said transmission lever is made of spring steel.

12. An actuating device for a decompression valve of an internal combustion engine with a cable starter, wherein the decompression valve is positioned within a cylinder of the internal combustion engine and comprises a valve member biased into its closed position; said actuating device comprising:

a transmission lever having a longitudinal extension and being rotatable about its longitudinal axis, said transmission lever having a first and a second end;

a cable drum for receiving the starter cable of the cable starter, said cable drum having an axis of rotation about which said cable drum is rotated in a direction of rotation when the starter cable is pulled;

said longitudinal axis of said transmission lever positioned perpendicular to said axis of rotation of said cable drum and spaced from a rotational plane of said cable drum; and wherein said cable drum entrains said first end of said transmission lever in said direction of rotation and thereby rotates said transmission lever about said longitudinal axis such that said second end of said transmission lever performs an adjusting movement for moving said decompression valve from the closed position into an open position; and wherein said cable drum has an outer mantle surface and wherein said outer mantle surface is in the form of a friction ring frictionally connected to said cable drum.

13. An actuating device according to claim 3, further comprising a spring ring positioned between said friction ring and said cable drum for frictionally connecting said friction ring to said cable drum.

14. An actuating device according to claim 12, wherein said first end of said transmission lever rests frictionally on said friction ring of said cable drum.

15. An actuating device according to claim 12, wherein said first end of said transmission lever rests under prostress on said friction ring.

16. An actuating device according to claim 12, wherein said longitudinal axis of said transmission lever intercepts said axis of rotation of said cable drum.

17. An actuating device according to claim 12, wherein said transmission lever is comprised of a transmission rod coinciding with said longitudinal axis of said transmission lever, said transmission rod having angled end pieces forming said first and second ends of said transmission lever.

18. An actuating device according to claim 12, further comprising an abutment for limiting said adjusting movement of said second end for opening said decompression valve.

19. An actuating device according to claim 12, wherein a rotational travel of said transmission lever for moving said decompression valve from the closed position into an open position is completed when said cable drum is rotated about a rotational angle of 20° to 60°.

20. An actuating device according to claim 19, wherein said rotational angle is 45°.

21. An actuating device according to claim 12, further comprising a guide for said transmission lever, said guide connected to the cylinder.

22. An actuating device according to claim 12, wherein said transmission lever is supported at a cover for the engine.

23. An actuating device according to claim 12, wherein said transmission lever is made of a material with a high elasticity module.

24. An actuating device according to claim 23, wherein said transmission lever is made of spring steel.

* * * * *